US006279476B1

(12) United States Patent
Ellis

(10) Patent No.: US 6,279,476 B1
(45) **Date of Patent: *Aug. 28, 2001**

(54) LITHOGRAPHIC IMAGING WITH CONSTRUCTIONS HAVING INORGANIC OLEOPHILIC LAYERS

(75) Inventor: Ernest W. Ellis, Harvard, MA (US)

(73) Assignee: Presstek, Inc., Hudson, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/390,553

(22) Filed: Sep. 3, 1999

Related U.S. Application Data

(63) Continuation-in-part of application No. 09/151,497, filed on Sep. 11, 1998, now Pat. No. 6,073,559.

(51) Int. Cl.[7] ..... B41N 1/14

(52) U.S. Cl. ..... 101/454; 101/458; 101/467

(58) Field of Search ..... 101/453, 454, 101/455, 458, 459, 465, 466, 467; 430/302

(56) References Cited

U.S. PATENT DOCUMENTS

| | | | | |
|---|---|---|---|---|
| Re. 35,512 | * | 5/1997 | Nowak et al. | 101/454 |
| 3,996,057 | * | 12/1976 | Kawaziri et al. | 101/467 |
| 4,150,623 | * | 4/1979 | Hamilton | 101/466 |
| 5,339,737 | * | 8/1994 | Lewis et al. | 101/454 |
| 5,783,364 | * | 7/1998 | Ellis et al. | 101/467 |
| 5,786,129 | * | 7/1998 | Ellis | 101/457 |
| 5,807,658 | * | 9/1998 | Ellis et al. | 101/457 |
| 5,906,909 | * | 5/1999 | Ellis | 101/456 |
| 5,916,734 | * | 6/1999 | Takagami et al. | 430/302 |
| 5,924,364 | * | 7/1999 | Grabley et al. | 101/457 |
| 5,927,207 | * | 7/1999 | Ghosh et al. | 101/455 |
| 6,073,559 | * | 6/2000 | Ellis | 101/454 |

FOREIGN PATENT DOCUMENTS

| | | | | |
|---|---|---|---|---|
| 0825021A2 | | 2/1998 | (EP) . | |
| 0844080A2 | | 5/1998 | (EP) . | |
| 57-3507 | * | 1/1982 | (JP) | 101/467 |
| WO98/30400 | | 7/1998 | (WO) . | |

* cited by examiner

*Primary Examiner*—Stephen R. Funk
(74) *Attorney, Agent, or Firm*—Testa Hurwitz & Thibeault LLP

(57) ABSTRACT

Negative-working and positive-working lithographic plate constructions include a durable hydrophilic layer; a hard, inorganic, oleophilic layer; and a substrate, which may be metal. If a metal substrate is employed, an overlying layer provides sufficient thermal insulation to prevent substantial dissipation of heat—which is necessary to achieve ablation—into the substrate. In the case of oleophilic layers employed in negative-working embodiments, certain ceramic materials are suitable, and an intermediate tying layer may be used to anchor a hydrophilic ceramic layer to the oleophilic layer. In positive-working embodiments, the oleophilic layers may be refractory compounds doped with oleophilic material. An advantage to the latter embodiments is the ability to apply traditional means of correction following imaging.

74 Claims, 1 Drawing Sheet

LITHOGRAPHIC IMAGING WITH CONSTRUCTIONS HAVING INORGANIC OLEOPHILIC LAYERS

RELATED APPLICATION

This is a continuation-in-part of U.S. Ser. No. 09/151,497, filed on Sep. 11, 1998 now U.S. Pat. No. 6,073,559.

FIELD OF THE INVENTION

The present invention relates to digital printing apparatus and methods, and ore particularly to imaging of lithographic printing-plate constructions on- or off-press using digitally controlled laser output.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers.

For example, U.S. Pat. Nos. 5,783,364 and 5,807,658, the entire disclosures of which are hereby incorporated by reference, describe a variety of lithographic plate configurations for use with such imaging apparatus. In general, the plate constructions include an inorganic layer (i.e., a metal, combination of metals, or a metal/non-metal compound) situated on an organic polymeric layer. The inorganic layer ablates in response to imaging (e.g., infrared, or "IR") radiation. In one approach, the inorganic layer represents the topmost surface of the plate and accepts dampening fluid, while the underlying polymeric layer accepts ink. Application of an imaging pulse to a point on the plate ultimately creates an image spot having an affinity for a dampening fluid differing from that of unexposed areas, the pattern of such spots forming a lithographic plate image.

These types of plates can exhibit performance limitations, particularly after high numbers of impressions, owing to the abrupt transition between a hard inorganic layer and a soft organic, polymeric layer. The divergent physical and chemical characteristics of such distinct layers can compromise their anchorage to one another—a critical performance requirement—as well as the durability of the inorganic layer. For example, because inorganic and organic materials typically have very different coefficients of thermal expansion and elastic moduli, even perfectly adhered inorganic layers may undergo failure (e.g., fracturing) due to temperature variations or the stress of plate manipulation and use. The different responses of two adjacent layers to an external condition can easily cause damage that would not occur in either layer by itself.

To improve interlayer anchorage, polymeric layers may be selected (or applied as intermediate coatings) based on chemical compatibility with inorganic material. A polymeric layer may also be pretreated (e.g., through plasma exposure) to modify the surface for greater interfacial compatibility with a subsequently applied inorganic layer. These approaches, however, have limited utility in addressing the effects of transition between fundamentally different materials.

DESCRIPTION OF THE INVENTION

Brief Summary of the Invention

The present invention replaces the conventional polymeric ink-accepting layer with a hard, inorganic material that exhibits sufficient flexibility (at the deposition thicknesses envisioned) to accommodate the flexing and bending required of lithographic printing plates. This plate layer may overlie a relatively heavy, metal plate substrate or support (although, again, one flexible enough to accommodate plate mounting and use), resulting in a structure whose permanent layers all share the physical properties of inorganic materials.

The plates may also be provided with a protective layer that serves a variety of beneficial functions, including protection against handling and environmental damage and extension of plate shelf life, but which also is removed during the printing make-ready process.

In general, the plate constructions of the present invention include a durable hydrophilic layer; a hard, inorganic, oleophilic layer; and a substrate which, as noted above, may itself be metal. If a metal substrate is employed, an overlying layer provides sufficient thermal insulation to prevent substantial dissipation of heat—which is necessary to achieve ablation—into the substrate. Accordingly, in this context, the degree of thermal insulation is adequate if the imaging power (at a given pulse width) necessary for ablation is comparable to that used in connection with plates having thermally insulating (e.g., polyester) substrates.

The plates of the present invention can be either "positive-working" or "negative-working." In positive-working versions, areas that are inherently ink-receptive receive laser output and are removed, revealing the hydrophilic layer that will reject ink during printing; in other words, the "image area" is selectively removed to reveal the "background." In negative-working versions, areas that are inherently hydrophilic are removed to reveal an underlying ink-receptive image layer.

In all disclosed embodiments, the applied inorganic layers are desirably hard and adequately flexible at application thicknesses, and resist degradation by solvents typically used during press operation; in addition, all layers other than the ablation layer are thermally stable (exhibiting, for example, high melting points that resist degradation by imaging radiation), and reflect or at least do not absorb imaging radiation. In the case of oleophilic layers employed in negative-working embodiments, certain ceramic materials (as defined below) are suitable, and an intermediate tying layer may be used to anchor a hydrophilic ceramic layer to the oleophilic layer. In positive-working embodiments, the oleophilic layers may be refractory compounds doped with oleophilic material. An advantage to the latter embodiments is the ability to apply traditional means of correction following imaging and/or physical damage.

It should be stressed that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention, when taken in conjunction with the accompanying drawings, in which.

Figure 1:
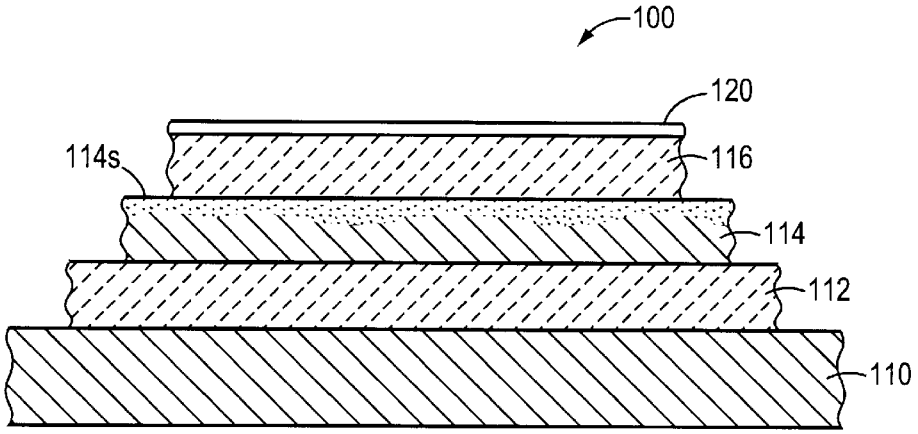
FIG. 1 is an enlarged sectional view of a negative-working lithographic printing member in accordance with the present invention.

The drawings and elements thereof may not be drawn to scale.

DETAILED DESCRIPTION OF THE PREFERRED EMBODIMENTS

Imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. Nos. Re. 35,512 and 5,385,092 (the entire disclosures of which are hereby incorporated by reference); lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows"in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after To completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby utilize high laser pulse rates, can frequently utilize a single laser as an imaging source.

With reference to FIG. 1, a representative negative-working construction 100 includes a hard substrate 110, a hard ceramic layer 112, a tying layer 114, and a hydrophilic, metallic inorganic layer 116. Substrate 110 is strong, stable and flexible, and is preferably a metal sheet. Preferred metal substrates have thicknesses of 0.005 inch or more. For example, the aluminum coil traditionally employed to produce textured-surface plates (by graining and anodizing) can be used.

Alternatively, substrate 110 may be a multilayer composite including a relatively thin foil layer (in order to ease application of the overlying layers) laminated to a heavier metal or non-metal substrate. Suitable techniques of lamination are described, for example, in U.S. Pat. No. 5,188,032, and in the '512 and '092 patents.

Layer 112 is oleophilic, hard, and flexible enough to permit normal handling and mounting procedures at the envisioned deposition thicknesses. If substrate 110 is thermally conductive, layer 112 should also provide a thermal barrier, preventing significant dissipation of heat into substrate 110. Without sufficient insulation, at least some of the energy delivered by the imaging device will leave layers 114, 116 before the catastrophic overheating that characterizes ablation is achieved, thereby increasing imaging power requirements or preventing ablation altogether.

In addition to shielding the passage of heat, layer 112 should resist the action of the imaging process as well as the rigors of printing. During imaging, layer 112 must maintain its own internal integrity notwithstanding the application of radiation to overlying plate layers 114, 116, as well as the evolution of thermal energy from ablation of those layers. Thus, the material of layer 112 must have a high enough melting point to withstand the heat to which it is exposed, and ideally also reflects imaging radiation so as not to be affected by radiation that passes, unabsorbed, through layers 112, 114. The more inherently thermally insulating, hard, and durable the material of layer 112, the smaller will be the required deposition thickness. Generally, layer 112 is deposited at a thickness of at least 500 Å.

During printing, layer 112 should not degrade despite repeated exposure to press solvents (fountain solution, ink-borne solvents, etc.) throughout the expected useful life of the plate. Similarly, layer 112 must be sufficiently refractory to withstand the repeated mechanical stresses of the printing process.

Finally, if layers 114, 116 are applied by a vacuum process, manufacturing efficiencies favor the ability to apply layer 112 by a vacuum process (e.g., sputtering or reactive sputtering) as well. But other processes, such as flame spraying (see *Handbook of Thin Film Process Technology*, IOP Publishing 1995), may also be employed to advantage.

Preferred materials for layer 112 include ceramics, a class of material which, for purposes hereof, is intended to connote refractory oxides, carbides, and nitrides of metals or nonmetals. These materials may be covalent in nature, and may have both high melting points (generally 1900° C. or higher) and high Young's moduli (typically 200 kN/mm$^2$ or higher). Moreover, in ceramic materials the high values of Young's modulus are preserved up to temperatures approaching the melting point. Representative ceramics include such covalent hard materials as $B_4C$, BN, $AlB_{12}$, SiC, SiB, $Si_3N_4$, and AlN, among others. Suitable materials may also include dopants, such as copper, to improve ink receptivity.

Layer 114, which is optional, is a metal that may or may not develop a native oxide surface 114*s* upon exposure to air during the plate-fabrication process. The thickness of layer 114 depends on the application. If made too thin, the layer will not absorb sufficient radiation to undergo ablation; if too thick, it will reflect, rather than absorb, radiation and once again will fail to ablate. Generally layer 114 is applied at thicknesses of 50–5000 Å. Layer 114 functions as a tying layer if the surface characteristics of hard layer 112 are not well-suited to acceptance and anchorage of the metallic inorganic layer, and may otherwise be omitted. The metal of layer 114 is at least one d-block (transition) metal, aluminum, indium or tin. In the case of a mixture, the metals are present as an alloy or an intermetallic. Oxidation can occur on both metal surfaces, and may also, therefore, affect adhesion of layer 114 to hard layer 112 (or other underlying layer).

Layer 116 is a metallic inorganic layer comprising a compound of at least one metal with at least one non-metal, or a mixture of such compounds. It is generally applied at a thickness of 100–5000 Å or greater; however, optimal thickness is determined primarily by the overall structure and identity of the other layers, as well as durability concerns, economic considerations, and convenience of application. The metal component of layer 116 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 116 may be one or more of the p-block elements boron, carbon, nitrogen, oxygen and silicon. A metal/non-metal compound in accordance herewith may or may not have a definite stoichiometry, and may in some cases (e.g., Al—Si compounds) be an alloy. Preferred metal/non-metal combinations include TiN, TiON, $TiO_x$ (where $0.9 \leqq x \leqq 2.0$), TiAlN, TiAlCN, TiC and TiCN.

A protective layer 120 may be deposited over metallic inorganic layer 116. If added, this layer can serve a variety of beneficial functions: providing protection against handling and environmental damage, and also extending plate shelf life, but the bulk disappearing during make-ready; assisting with cleaning by entraining debris and carrying it away as the layer itself is mostly removed during press make-ready; acting as a debris-management barrier, preventing the accumulation of airborne debris that might interfere with unimaged areas and/or imaging optics; and exhibiting hydrophilicity (as that term is used in the printing industry, i.e., accepting fountain solution), thereby accelerating plate "roll-up"—that is, the number of preliminary impressions necessary to achieve proper quality of the printed image. Protective layer 120 performs these functions but mostly disappears in the course of the normal "make-ready" process that includes roll-up—indeed, even accelerates that process.

Protective layer 120 preferably comprises a polyalkyl ether or polyvinyl alcohol compound with a molecular weight that depends on the mode of application and the conditions of plate fabrication. For example, when applied as a liquid, the polyalkyl ether or polyvinyl alcohol compound may have a relatively substantial average molecular weight (i.e., at least 600) if the plate undergoes heating during fabrication or experiences heat during storage or shipping; otherwise, lower molecular weights are acceptable. A coating liquid should also exhibit sufficient viscosity to facilitate even coating at application weights appropriate to the material to be coated.

A preferred formulation for aqueous coating 120 comprises 2.5 parts polyvinyl alcohol (e.g., the Airvol 203 product sold by Air Products and Chemicals, Allentown, Pa.) dispersed in 89.37 parts deionized water at room temperature using sufficient agitation to wet out all particles with water. The temperature of the dispersion is elevated to 85–96° C., and held for 30 min with continuous agitation. After the temperature of the resulting clear solution cools to room temperature, 0.13 parts diethyleneglycol and 8 parts methyl alcohol are added.

The solution is coated over a ceramic printing plate surface and dried to provide a protective layer at a thickness of about 0.2 to 0.4 $\mu$m.

More generally, the protective layer 120 is preferably applied at a minimal thickness consistent with its roles, i.e., providing protection against handling and environmental damage, extending plate shelf life by shielding the plate from airborne contaminants, and entraining debris produced by imaging. The thinner layer 120 can be made, the more quickly it will be removed during press make-ready, the shorter will be the roll-up time, and the less the layer will affect the imaging sensitivity of the plate.

Figure 2:
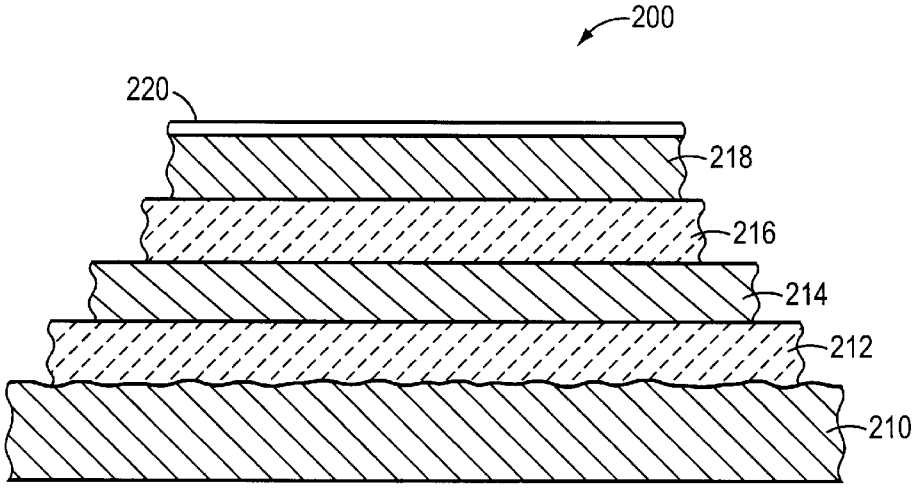
FIG. 2 is an enlarged sectional view of a positive-working lithographic printing member in accordance with the present invention.

Refer now to FIG. 2, which illustrates a positive-working plate in accordance with the invention. The illustrated construction 200 includes a hard substrate 210, an inorganic hydrophilic layer 212, a thin metal layer 214, and a metallic inorganic layer 216. The affinity characteristics of layer 216 are modified by application of a very thin oleophilic layer 218, which interacts with layer 218 to impart oleophilicity thereto. The construction 200 may be covered by a protective layer 220.

In this embodiment, layer 212 receives fountain solution rather than ink during the printing process, and therefore must be hydrophilic, hard, and flexible. Layer 212 is ordinarily a ceramic material, as defined above, and preferably a metal oxide. A suitable material is indium tin oxide applied at a thickness of 1000–5000 Å. Once again, this layer resists the action of laser radiation and the effect of ablating overlying layers, as well as the rigors of use, and preventing significant heat dissipation into the substrate 210. Preferably, substrate 210 is an anodized aluminum sheet as described above; the textured surface of an anodized substrate 210 ensures good adhesion to overlying layer 212 as well as providing thermal insulation.

Layer 212 is revealed during the imaging process as layers 214, 216, 218 ablate by exposure to imaging radiation. Consequently, layers 214, 216, 218 are applied at a collective thickness that does not preclude laser-induced ablation. Layer 214, like layer 114 described above, is an optional tying layer applied at a thickness of 50–5000 Å; a representative layer is titanium metal applied to a thickness of 300 Å, but once again, layer 114 may be at least one d-block (transition) metal, aluminum, indium or tin (the metals being present, in the case of a mixture, as an alloy or an intermetallic).

Layer 216 is a metallic inorganic layer analogous to layer 116 described above in terms of composition, but unlike that layer, does not receive fountain solution in the printing process. Instead, its function is to combine with overlying layer 218 to serve as an ink-accepting surface. In effect, layer 218 dopes layer 216, conferring oleophilicity thereto. Layer 216 may be applied at thicknesses ranging from 100–5000 Å, but given the need to economically ablate three layers, thicknesses on the order of 300 Å are preferred.

Layer 218 is oleophilic, and may be an oleophilic metal such as copper, gold, silver, platinum or an oleophilic ceramic (such as BN) as described above. Layer 218, like the others, may be deposited by a vacuum process, and given its role—to penetrate layer 216 in order to impart oleophilicity—may be quite thin. For example, a layer of copper 50 Å or less in thickness applied onto a 300 Å layer of titanium nitride has been employed to advantage.

The plates 100, 200 may be utilized with wet-printing ink systems, or with single-fluid inks that contain both polar (hydrophilic) and nonpolar (oleophilic) phases. The plate 200, however, lends itself to traditional correction (sometimes called "deletion" and "addition") techniques. In accordance with such techniques, which are commonly applied to aluminum-based wet plates, a stylus or an etching reagent is used to selectively remove spurious or unwanted ink-accepting regions to reveal the hydrophilic aluminum. In a similar fashion, deletion fluids (such as the POLY DELETE PEN product supplied by Base-Line Inc., Auburn, Wash.) applied to plate 200 will etch away layers 214, 216, 218 to reveal hydrophilic layer 212.

In "addition" techniques, a polymeric oleophilic material is deposited directly onto the hydrophilic aluminum, thereby transforming "background" into "image" areas. Similarly, addition materials (such as a fine-point permanent marker) will adhere well to layer 212, and may be deposited thereon to reverse the effect of unwanted removal of the overlying layers.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member having a printing surface and including first and second inorganic layers and an inorganic support under the first and second layers, wherein (i) the first layer, but not the second layer, is formed of a material subject to ablative absorption of imaging radiation, (ii) the first and second layers differ in affinity for at least one of ink and a liquid to which ink will not adhere, and (iii) the first layer comprises a doped compound of at least one metal with at least one non-metal, the at least one non-metal being selected from the group consisting of boron, carbon, nitrogen, silicon and oxygen, a dopant being integrated within the compound and imparting oleophilicity thereto;

b. selectively exposing, in a pattern representing an image, the printing surface to laser radiation so as to ablate the first layer but not the second layer; and c. removing remnants of the first layer where the printing member received radiation.

2. The method of claim 1 wherein the first layer is hydrophilic and the second layer is oleophilic.

3. The method of claim 1 wherein the first layer is oleophilic and the second layer is hydrophilic.

4. The method of claim 3 further comprising the step of removing the first layer in unwanted oleophilic areas to reveal the second layer.

5. The method of claim 3 further comprising the step of applying an oleophilic polymer to unwanted exposed areas of the second layer.

6. The method of claim 1 wherein the inorganic support comprises a metal, the second layer providing thermal insulation between the ablatable first layer and the inorganic support.

7. The method of claim 1 wherein the compound is applied as a layer and the dopant is deposited onto the compound layer.

8. The method of claim 1 wherein the dopant is copper.

9. The method of claim 1 wherein the dopant is a ceramic.

10. The method of claim 9 wherein the dopant comprises a compound comprising boron.

11. The method of claim 10 wherein the dopant comprises $B_4C$.

12. The method of claim 10 wherein the dopant comprises BN.

13. The method of claim 10 wherein the dopant comprises $AlB_{12}$.

14. The method of claim 10 wherein the dopant comprises $SiB_6$.

15. The method of claim 9 wherein the dopant comprises SiC.

16. The method of claim 9 wherein the dopant comprises $Si_3N_4$.

17. The method of claim 9 wherein the dopant comprises AlN.

18. The method of claim 1 wherein the printing member further comprises a metal tying layer between the first and second layers.

19. The method of claim 18 wherein the metal layer comprises at least one of (i) a d-block transition metal, (ii) aluminum, (iii) indium and (iv) tin.

20. The method of claim 19 wherein the metal layer is titanium.

21. The method of claim 1 wherein the compound of the first layer comprises at least one of (i) a d-block transition metal, (ii) an f-block lanthanide, (iii) aluminum, (iv) indium and (v) tin.

22. The method of claim 1 wherein the compound of the first layer comprises at least one of (i) titanium, (ii) zirconium, (iii) vanadium, (iv) niobium, (v) tantalum, (vi) molybdenum and (vii) tungsten.

23. The method of claim 1 wherein the compound of the first layer comprises a boride.

24. The method of claim 1 wherein the compound of the first layer comprises a carbide.

25. The method of claim 1 wherein the compound of the first layer comprises a nitride.

26. The method of claim 1 wherein the compound of the first layer comprises a carbonitride.

27. The method of claim 1 wherein the compound of the first layer comprises a silicide.

28. The method of claim 1 wherein the compound of the first layer comprises an oxide.

29. The method of claim 1 wherein the compound of the first layer is TiN.

30. The method of claim 1 wherein the compound of the first layer is TiC.

31. The method of claim 1 wherein the compound of the first layer is TiCN.

32. The method of claim 1 wherein the compound of the first layer is $TiO_x$ (wherein $0.9 \leqq x \leqq 2.0$).

33. The method of claim 1 wherein the compound of the first layer is TiON.

34. The method of claim 1 wherein the compound of the first layer is TiAlN.

35. The method of claim 1 wherein the compound of the first layer is TiAlCN.

36. The method of claim 1 wherein the printing member further comprises a hydrophilic barrier layer, removable by dampening fluid on the first layer.

37. The method of claim 1 wherein the second layer is a ceramic.

38. A method of imaging a lithographic printing member, the method comprising the steps of:

a. providing a printing member having a printing surface and including first and second inorganic layers and an inorganic support under the first and second layers, the first layer, but not the second layer, being formed of a material subject to ablative absorption of imaging radiation, the first and second layers differing in affinity for at least one of ink and a liquid to which ink will not adhere, the second layer being a hydrophilic metal oxide comprising indium tin oxide;

b. selectively exposing, in a pattern representing an image, the printing surface to laser radiation so as to ablate the first layer but not the second layer; and c. removing remnants of the first layer where the printing member received radiation.

39. A lithographic printing member comprising:

a. an inorganic first layer;

b. an inorganic second layer underlying the first layer; and c. an inorganic support under the first and second layers; wherein d. the first layer, but not the second layer, is formed of a material subject to ablative absorption of imaging radiation;

e. the first and second layers differ in affinity for at least one of ink and a liquid to which ink will not adhere; and f. the inorganic support comprises a metal, the second layer providing thermal insulation between the ablatable first layer and the inorganic support.

40. A lithographic printing member comprising:

a. an inorganic first layer;

b. an inorganic second layer underlying the first layer; and c. an inorganic support under the first and second layers; wherein d. the first layer, but not the second layer, is formed of a material subject to ablative absorption of imaging radiation;

e. the first and second layers differ in affinity for at least one of ink and a liquid to which ink will not adhere; and f. the first layer comprises a doped compound of at least one metal with at least one non-metal, the at least one non-metal being selected from the group consisting of boron, carbon, nitrogen, silicon and oxygen, a dopant being integrated within the compound and imparting oleophilicity thereto.

41. The member of claim 40 wherein the first layer is hydrophilic and the second layer is oleophilic.

42. The member of claim 40 wherein the first layer is oleophilic and the second layer is hydrophilic.

43. The member of claim 40 wherein the compound is applied as a layer and the dopant is deposited onto the compound layer.

44. The member of claim 40 wherein the dopant is copper.

45. The member of claim 40 wherein the dopant is a ceramic.

46. The member of claim 45 wherein the dopant comprises a compound comprising boron.

47. The member of claim 46 wherein the dopant comprises $B_4C$.

48. The member of claim 46 wherein the dopant comprises BN.

49. The member of claim 46 wherein the dopant comprises $AlB_{12}$.

50. The member of claim 46 wherein the dopant comprises $SiB_6$.

51. The member of claim 45 wherein the dopant comprises SiC.

52. The member of claim 45 wherein the dopant comprises $Si_3N_4$.

53. The member of claim 45 wherein the dopant comprises AlN.

54. The member of claim 40 wherein the printing member further comprises a metal tying layer between the first and second layers.

55. The member of claim 54 wherein the metal layer comprises at least one of (i) a d-block transition metal, (ii) aluminum, (iii) indium and (iv) tin.

56. The member of claim 55 wherein the metal layer is titanium.

57. The member of claim 40 wherein the compound of the first layer comprises at least one of (i) a d-block transition metal, (ii) an f-block lanthanide, (iii) aluminum, (iv) indium and (v) tin.

58. The member of claim 40 wherein the compound of the first layer comprises at least one of (i) titanium, (ii) zirconium, (iii) vanadium, (iv) niobium, (v) tantalum, (vi) molybdenum and (vii) tungsten.

59. The member of claim 40 wherein the compound of the first layer comprises a boride.

60. The member of claim 40 wherein the compound of the first layer comprises a carbide.

61. The member of claim 40 wherein the compound of the first layer comprises a nitride.

62. The member of claim 40 wherein the compound of the first layer comprises a carbonitride.

63. The member of claim 40 wherein the compound of the first layer comprises a silicide.

64. The member of claim 40 wherein the compound of the first layer comprises an oxide.

65. The member of claim 40 wherein the compound of the first layer is TiN.

66. The member of claim 40 wherein the compound of the first layer is TiC.

67. The member of claim 40 wherein the compound of the first layer is TiCN.

68. The member of claim 40 wherein the compound of the first layer is $TiO_x$ (wherein $0.9 \leqq x \leqq 2.0$).

69. The member of claim 40 wherein the compound of the first layer is TiON.

70. The member of claim 40 wherein the compound of the first layer is TiAlN.

71. The member of claim 40 wherein the compound of the first layer is TiAlCN.

72. The member of claim 40 wherein the printing member further comprises a hydrophilic barrier layer, removable by dampening fluid on the first layer.

73. The member of claim 40 wherein the second layer is a ceramic.

74. A lithographic printing member comprising:

a. an inorganic first layer;

b. an inorganic second layer underlying the first layer; and c. an inorganic support under the first and second layers; wherein d. the first layer, but not the second layer, is formed of a material subject to ablative absorption of imaging radiation; and e. the first and second layers differ in affinity for at least one of ink and a liquid to which ink will not adhere, the second layer being a hydrophilic metal oxide comprising indium tin oxide.

* * * * *